United States Patent [19]

Yokosuka

[11] 4,432,476

[45] Feb. 21, 1984

[54] BAND ATTACHMENT ASSEMBLY FOR ATTACHING A WATCHBAND TO A WATCHCASE

[75] Inventor: Koichi Yokosuka, Tokyo, Japan

[73] Assignee: Seiko Instruments & Electronics Ltd., Tokyo, Japan

[21] Appl. No.: 474,269

[22] Filed: Mar. 11, 1983

[30] Foreign Application Priority Data

Mar. 12, 1982 [JP] Japan ..... 57-34759[U]

[51] Int. Cl.[3] ..... A44C 5/00

[52] U.S. Cl. ..... 224/164; 24/265 WS

[58] Field of Search ..... 224/164, 168, 171, 177, 224/180; 24/265 WS

[56] References Cited

U.S. PATENT DOCUMENTS 2,567,398 9/1951 Pfeifer ..... 24/265 WS
3,581,960 6/1971 Ojima ..... 24/265 WS
3,795,353 3/1974 Weiss ..... 24/265 WS X
4,389,006 6/1983 Nagata ..... 224/164

FOREIGN PATENT DOCUMENTS 53-68280 6/1978 Japan ..... 224/164

*Primary Examiner*—Steven M. Pollard
*Attorney, Agent, or Firm*—Robert E. Burns; Emmanuel J. Lobato; Bruce L. Adams

[57] ABSTRACT

A band attachment assembly comprises a pushpin connected to a watchcase in such manner to define a clearance between the pushpin and the case. A generally Z-shaped holding member is secured to one end of a watchband and inserted through the clearance for engagement with the rear portion of the case. A locking member is inserted into the clearance at a location between the pushpin and the holding member to effectively lock the holding member to the case such that the end face of the band tightly abuts a surface of the case so that the watchcase and watchband have the appearance of an integral one-piece structure.

22 Claims, 11 Drawing Figures

BAND ATTACHMENT ASSEMBLY FOR ATTACHING A WATCHBAND TO A WATCHCASE

BACKGROUND OF THE INVENTION

The present invention pertains generally to assemblies for attaching a wristband to an article to be worn on the wrist and more particularly to assemblies for attaching a watchband to a watchcase.

An important aspect in the design and manufacture of wristwatches is the aesthetic appearance of the watch. Much effort has been devoted to manufacturing watchcases which exhibit a pleasing appearance and which create the impression that the watchcase and watchband are an integral structure. In the higher grade, more expensive wristwatches, the band is integrally secured by soldering to the case to create the impression of an integral one-piece structure.

One drawback of these prior art constructions is that usually the useful life of the watchband is considerably shorter than that of the watchcase. Thus should the band become damaged beyond reasonable repair, both the watchcase and watchband must be discarded even though there may be nothing wrong with the watchcase. Due to the fact that the band is soldered to the case, it is not practical, and in some instances not possible, for a damaged band to be removed from the case and replaced by a new one in the after-service market. This presents a serious problem to the manufacturer and results in considerable expense in the event the manufacturer assures both the watchcase and the watchband.

In an effort to overcome this drawback, watch manufacturers are continually seeking to devise a watch structure wherein the watchcase and watchband are connected together in such manner as to create the appearance of an integral one-piece structure yet which enables the band to be readily detached from the case and replaced by a new band and in this manner more fully utilize the useful life of the watchcase. Watch structures which have the band soldered to the case have not proved satisfactory due to the difficulties encountered in removing and replacing the band without marring the appearance of the watch structure. Other attempts have been made to devise a watch structure in which the band is mechanically attached to the case and though these structures permit easy removal and replacement of the band, such structures do not satisfactorily exhibit an integral one-piece appearance and thus are unsuitable for use with high quality watches.

SUMMARY OF THE INVENTION

It is, therefore, one object of the present invention to provide a band attachment assembly for attaching a wristband to an article which overcomes the drawbacks of prior art constructions.

Another object of the present invention is to provide a band attachment assembly for attaching a wristband to an article in such manner that the band can be easily removed and replaced and in which the article and wristband have the appearance of an integral structure.

A further object of the present invention is to provide a watchcase and watchband construction in which the band is removably attached to the case and in which the construction exhibits the appearance of an integral one-piece structure.

A still further object of the present invention is to provide a band attachment assembly for attaching a watchband to a watchcase in such manner that the assembled construction exhibits the appearance of an integral structure and in which the band can be conveniently removed and replaced.

Yet another object of the present invention is to provide a band attachment assembly for removably attaching a watchband to a watchcase and which is relatively simple and inexpensive to manufacture and which can be easily serviced in the after-service market.

The above and other objects of the invention are achieved by a band attachment assembly comprised of a pin connected to a watchcase in such manner to define a clearance between the pin and the case, a curved holding member secured to one end of a watchband and inserted through the clearance for engagement with the rear portion of the case, and a locking member which serves as a wedge insertable into the clearance at a location between the pin and the holding member to effectively lock the holding member to the case such that the end face of the band tightly abuts a surface of the case so that the watchcase and watchband have the appearance of an integral structure.

Having in mind the aforementioned objects as well as other objects of the invention which will become apparent from a reading of this disclosure, the present invention comprises a band attachment assembly and a watchcase construction incorporating the band attachment assembly as illustrated in the presently preferred embodiments which are hereinafter set forth in sufficient detail to enable those persons ordinarily skilled in the art to clearly understand the manner of carrying out the invention when the disclosure is read in conjunction with the accompanying drawings.

DETAILED DESCRIPTION OF PREFERRED EMBODIMENTS

Figure 1:
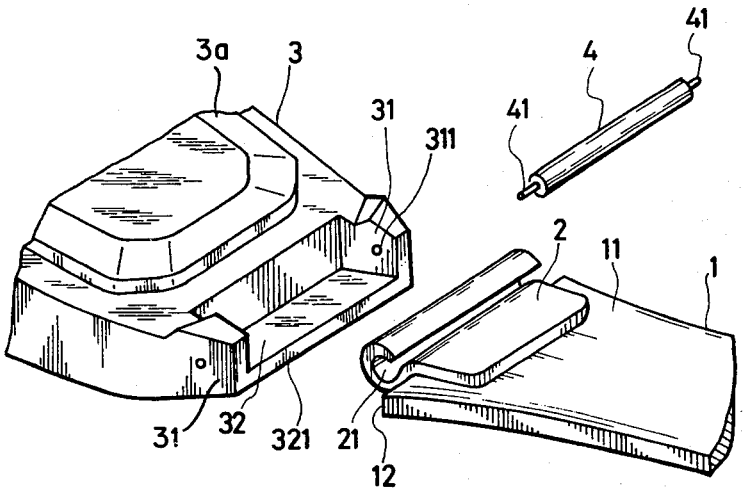
PRIOR ART FIG. 1
FIG. 1 is an exploded perspective view of a prior art band attachment assembly for attaching a wristband to a watchcase.
Figure 2:
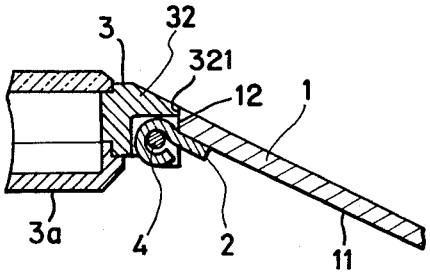
PRIOR ART FIG. 2
FIG. 2 is a cross-sectional view of the prior art assembly shown in FIG. 1 with the parts in an assembled state.

In order to more fully appreciate the advantages obtained by the present invention, a brief description will first be given with reference to FIGS. 1–2 of a typical prior art watch construction incorporating a prior art band attachment assembly. The prior art watch construction comprises a watchband 1 connected to a watchcase 3 by means of a connecting member 2 and a pushpin 4. To more clearly disclose the band attachment assembly, the watch structure is shown upside down in FIG. 1. The band 1 has an underside or rear side 11 and terminates in an end face 12 which is configured to abut against a corresponding surface of the case 3. The connecting member 2 is secured to one end of the band 1 and has an arcuate connecting portion 21 which is dimensioned to receive therein the pushpin 4.

The watchcase 3 has a back cover 3*a* and a recess defined by a pair of spaced apart lugs 31 and a web portion 32. The web portion 32 is disposed at the front portion of the case 3 so as to conceal the band attachment assembly which attaches the band 1 to the case 3 when the watch is being worn by a wearer. The web portion 32 of the case 3 has an end face 321 shaped to abut with the end face 12 of the band 1, as shown in FIG. 2, so as to create the appearance of an integral watch structure. Each of the lugs 31 is provided with a hole 311 for receiving therein a pin 41 of the pushpin 4.

During assembly, the pushpin 4 is inserted into the arcuate connecting portion 21 of the connecting member 2 and the connecting member 2 is then inserted into the watchcase recess so as to insert the pins 41 into the respective holes 311 formed in the lugs 31. In order that the end face 12 of the band 1 abut tightly against the end face 321 of the web portion 32 of the case 3, it is necessary that the tolerances of the parts be closely controlled and even a minor variation in the location of the holes 311 or the pins 41, or in the contour or size of the connecting portion 21 would result in a loss of the tight abutting relationship between the two end faces 12 and 321. Moreover, during assembly, it is first necessary to insert one pin 41 into its corresponding hole 311 and then force the pushpin 4 towards the hole in which the pin is engaged in order to insert the other pin 41 into its corresponding hole 311. During this assembly step, the end face 12 of the band 1 abuts against the end face 321 of the web portion 32 and in order to retain this abutting relationship, the pushpin 4 must be forcibly urged towards the case 3 and the force required for this purpose invariably results in deflection of one of the pushpins 41 so that when the assembly is completed, the deflected pin 41 results in an uneven abutment between the two end faces 12 and 321. In addition, during this assembly step, the pin 41 which has first been inserted in its corresponding hole 311 is deflected or bent to some degree as the pushpin 4 is moved back and forth, i.e., pivoted about the inserted pin 41, while seeking to insert the opposite pin 41 into its corresponding hole 311. Even though the amount of deflection of the pin 41 may be rather small, even a small deflection will result in an uneven abutment between the two end faces 12 and 321 so that the resulting watch structure will not exhibit the appearance of being an integral one-piece structure.

Figure 3:
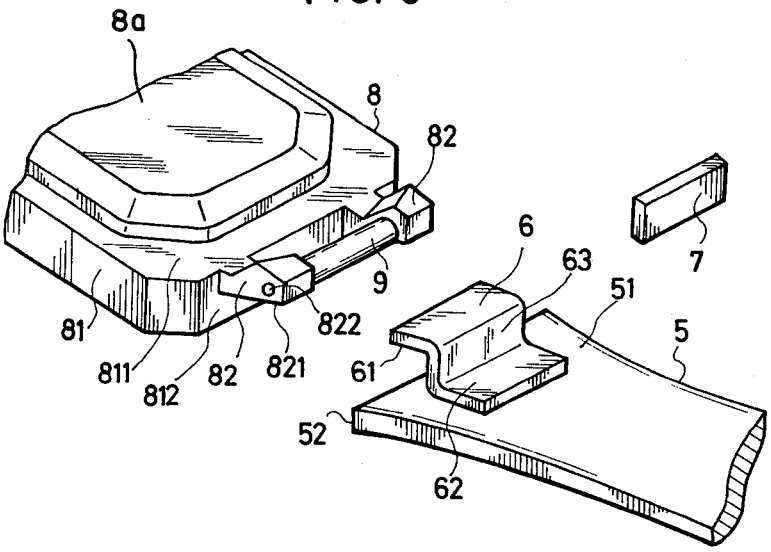
FIG. 3 is an exploded perspective view of a band attachment assembly for attaching a wristband to a watchcase according to one embodiment of the present invention.
Figure 4:
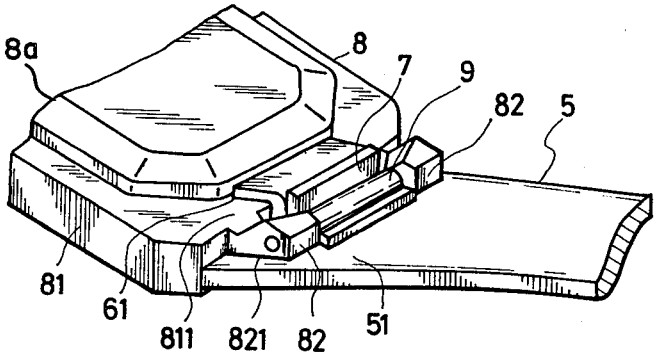
FIG. 4 is a perspective view of the watch structure shown in FIG. 3 in an assembled state.
Figure 5:
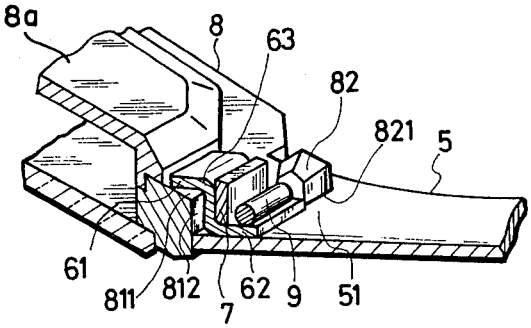
FIG. 5 is a cross-sectional perspective view of the watch structure shown in FIG. 4.

The present invention effectively overcomes the drawbacks of the prior art band attachment assemblies since according to the invention, the pins of the pushpin are not stressed and therefore are not deflected during connection of the pushpin to the watchcase. One embodiment of the invention is shown in FIGS. 3–5 which discloses a band attachment assembly for attaching a wristband to an article to be worn on the wrist of a wearer. In the disclosed embodiment, the article comprises a watchcase 8 and the wristband comprises a watchband 5 and for ease of description, the invention will be described hereinafter with reference to a watchcase and watchband.

The wristband 5 has an end face 52 which is shaped to abut against a correspondingly shaped surface of the watchcase 8. As in the case of FIG. 1, the watch structure shown in FIGS. 3–5 is shown in an upside down position so as to more clearly illustrate the band attachment assembly. The band 5 has an underside or rear side to which is secured a holding member 6. The holding member 6 has a curved generally Z-shaped configuration and is comprised of an engaging portion 61 which is engageable with a rear portion of the case 8, a securing portion 62 which is secured to the underside 51 of the band 5, and an intermediate upstanding portion 63 which is connected at opposite ends to the engaging and securing portions 61 and 62.

The watchcase 8 has a rear portion 811 on which is disposed a case back 8*a*, a front portion (not visible in the drawings) and a peripheral side portion 81 extending around the periphery of the case between the front and rear portions. The case 8 has a side surface 812 which is shaped to mate with and abut against the end face 52 of the band 5, as shown in FIGS. 4 and 5, when the band is attached to the case. A pair of lugs 82 project outwardly from the case 8 in spaced apart relationship and each lug is provided with a lug hole 822 for receiving therein one of the pins of a pushpin 9. The lugs 82 are provided with upper surfaces 821 for receiving thereon and abutting with the underside 51 of the band 5, as shown in FIG. 4, when the band is connected to the case. The pushpin 9 is connected to the case 8 by means of the lugs 82 such that a free clearance exists between the case 8 and the pushpin 9.

FIG. 3 shows the parts in a disassembled state and during assembly, the pushpin 9 is connected to the lugs 82 and during this assembly step, there is no need to forcibly urge the pushpin 9 towards the case 8 since the pushpin is connected to the case before attachment of the band to the case. Consequently, no deflection of the pins of the pushpin 9 occurs as the pins are not unduly stressed during this assembly step. After connection of the pushpin 9 to the case 8, the holding member 6 is inserted through the clearance between the case 8 and pushpin 9 in a direction from the front of the case to the rear of the case such that the engaging portion 61 extends through the clearance and rests on the case rear portion 811 in the manner shown in FIGS. 4 and 5. In this predetermined position, the engaging portion 61 engages with the rear portion of the case and the intermediate upstanding portion 63 is disposed in the clearance between the case 8 and pushpin 9, and the end face 52 of the band 5 abuts against the side surface 812 of the case 8. A plate-like locking member 7 is then inserted with a force fit into the clearance between the pushpin 9 and the upstanding portion 63 of the holding member 6 as shown in FIGS. 4 and 5 so as to releasably lock the holding member 6 in its predetermined position and thereby maintain the band end face 52 in tightly abutting relationship with the case side surface 812. At this time, the upper surfaces 821 of the lugs 82 abut against the underside 51 of the band 5. The tight abutting relationship is maintained by the wedging action of the locking member 7 which is forcibly inserted into the clearance space at a location between the pushpin 9 and the upstanding portion 63 of the holding member 6. The watch structure has the appearance of an integral one-piece structure and such an appearance is maintained during wearing of the watch due to the firm manner in which the abutting surfaces are urged towards one another.

In the event it is desirable to remove the band 5, this can simply be done by removing the locking member 7 and thereafter withdrawing the holding member 6 through the clearance. In this manner, the band can either be repaired or replaced by another band without the need of performing any soldering or other delicate operations.

With reference to the embodiment shown in FIGS. 3–5, the band attachment assembly comprises the pushpin 9, means 82 for connecting the pin to the watchcase to define the clearance between the pin and a side surface of the case, holding means 6 secured to one end of the band 5 and inserted through the clearance to a predetermined position for engaging with the rear portion of the case to thereby hold the band end face 52 in abutment with the side surface 812 of the case 8, and locking means 7 for locking the holding means in its predetermined position.

Figure 6A:
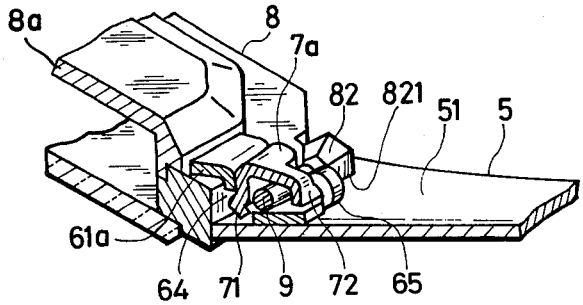
FIG. 6*a* is a cross-sectional perspective view similar to FIG. 5 through showing a second embodiment of a band attachment assembly according to the present invention.
Figure 6B:
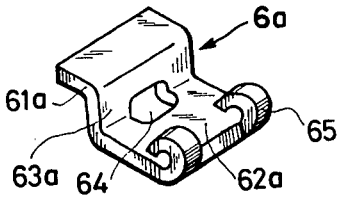
FIG. 6*b* is a perspective view of a holding member used in the embodiment shown in FIG. 6*a;*
Figure 6C:
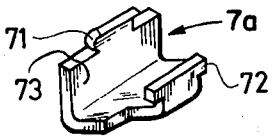
FIG. 6*c* is a perspective view of a locking member used in the embodiment shown in FIG. 6*a;*

Another embodiment of the invention is shown in FIGS. 6a–6c and to facilitate reading of the disclosure, parts which are the same in both embodiments are identified by the same reference characters and parts in the second embodiment which are different from though corresponding to parts in the first embodiment are identified by the same reference characters followed by the suffix "a". The second embodiment differs from the first in the construction of the holding means and the locking means. As shown in FIGS. 6a and 6b, the holding means 6a comprises a holding member comprised of a generally Z-shaped plate having an engaging portion 61a for engaging with a rear portion of the watchcase, a securing portion 62a which is secured to the underside of the watchband, and an intermediate upstanding portion 63a which is connected at opposite ends to the engaging and securing portions 61a and 62a. An opening 64 is provided at the juncture of the securing and intermediate portions 62a and 63a, and retaining means in the form of a pair of curved portions 65 are formed at the end of the securing portion 62a for turnably retaining the locking member.

FIG. 6c illustrates locking means 7a which coacts with the holding means 6a for releasably locking the holding means in a predetermined position so as to maintain the band end face in tight abutment with the side surface of the case. The locking means 7a comprises a resiliently deformable locking member having an arcuate or bent configuration. A first projection 71 projects outwardly from one side of the locking member and a second projection 72 projects outwardly from another side. The projection 71 curves slightly inwardly and is dimensioned to releasably engage in the opening 64 of the holding member 6a. The projection 72 is in the form of a pintle which is configured to the turnably retained by the pair of curved portions 65 of the holding member 6a as shown in FIG. 6a. The locking member 7a is composed of resiliently flexible material so as to enable the locking member to be compressively deformed to a deformed state in which the projections 71 an 72 are urged closer together to engage the opening 64 and retaining means 65.

During attachment of the band 5 to the case 8 in the second embodiment, the holding member 6a is secured to the end of the band 5 and the holding member is inserted through the clearance between the case 8 and the pushpin 9 in a direction from the front of the case to the rear of the case and positioned such that the engaging portion 61a engages with the rear portion 811 of the case 8. The locking member 7a is then orientated to the position shown in FIG. 6a and attached to the holding member 6a. This is done by fitting the projection 72 within the pair of curved portions 65 of the holding member 6a so that the projection 72 is turnably retained by the curved retaining portions 65. At this time, the locking member is in its relaxed, non-deformed state so that if the locking member were turned in the counterclockwise direction, as viewed in FIG. 6a, about the projection 72, the projection 71 would come to rest on the engaging portion 61a. In order to engage the locking member with the holding member, it is necessary to compressively deform the locking member to permit the projection 71 to clear the upstanding portion 63a and this is done by simply exerting downward pressure on the locking member in FIG. 6a to force the projection downwardly between the puspin 9 and the upstanding portion 63a until the projection 71 snaps into the opening 64 of the holding member 6a. In this manner, the locking member is forcibly inserted into the clearance at a location between the pushpin 9 and the intermediate upstanding portion 63a of the holding member 6a so that the side 73 of the locking member 7a functions as a wedge and due to the compressed state of the locking member, the locking member is snugly engaged with the holding member 6a and there is no danger that the locking member will loosen during wearing of the watch. Thus the band attachment assembly shown in FIGS. 6a–6c is particularly well suited for use with sport watches which must be able to withstand more rigorous handling than is necessary for formal dress watches. The engagement of the locking member projection 71 in the holding member opening 64 is quite adequate to prevent loosening of the band attachment assembly under even the most rigorous conditions to which the watch would be subjected during wearing.

Figure 7:
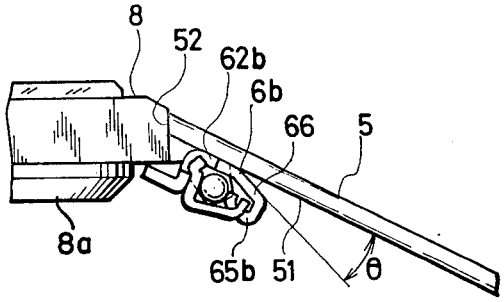
FIG. 7 is a side view of a watch structure incorporating a band attachment assembly according to a third embodiment of the present invention.

A variation of the embodiment shown in FIGS. 6a–6c is shown in FIG. 7 in which parts different from though corresponding to parts in the embodiment of FIG. 6 are identified by the same reference characters followed by the suffix "b". In this embodiment, the securing portion of the holding member 6b has two parts, a first part 62b secured to the underside of the watchband 5, and a second part 66 connected to the first part 62b and being inclined a predetermined angle $\theta$ in a direction away from the underside of the watchband when the watchband extends in a direction coplanar with the first part 62b. The advantage of this embodiment is that it enables the watchband 5 to assume a contour more closely resembling the contour of the wearer's wrist and thus enables a more snug fitting of the watchband.

Figure 8A:
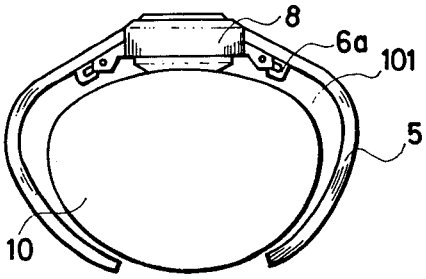
FIGS. 8*a* and 8*b* are explanatory views of watch structures showing the advantage of the embodiment of invention shown in FIG. 7.
Figure 8B:
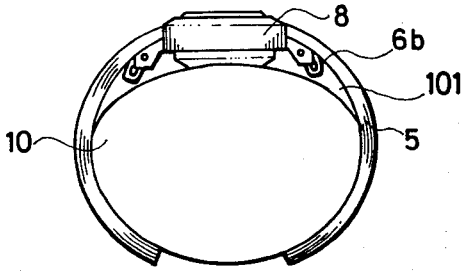

This advantage is shown in the explanatory drawings of FIGS. 8a and 8b. FIG. 8a shows a watch structure similar to, for example, that shown in FIG. 6a wherein the securing portion of the holding member 6 is planar whereby the band 5 must extend in a substantially straight manner a certain distance from the case 8 before the band 5 can bend to grip the arm 10 of the wearer. This results in a rather loose fitness of the watchband and a rather large gap 101 exists between the band 5 and the arm 10. In contrast, FIG. 8b shows a watch structure embodying the band attachment assembly shown in FIG. 7 and in which the securing portion of the holding member 6b is inclined or slanted relative to the band 5 so as to permit the band to bend towards the wearer's arm 10 in a tighter arc as opposed to the watch structure shown in FIG. 8*a*. This enables the band 5 to fit more snugly on the wearer's arm and reduces the size of the gap 101 thereby improving the fitness of the watchband.

Obvious changes and modifications will become apparent to those skilled in the art and the present invention is intended to cover all such changes and modifications falling within the spirit and scope of the invention as defined in the appended claims.

What I claim is:

1. A band attachment assembly for attaching a wristband to an article to be worn on the wrist of a wearer comprising: means including a pin connectable to the article for defining a clearance between the pin and an end portion of the article; holding means connected to one end of the wristband and configured to be inserted through the clearance for releasably engaging with a rear portion of the article to thereby hold the wristband in a predetermined position relative to the article and locking means for locking the wristband in said predetermined position relative to the article.

2. A band attachment assembly according to claim 1; wherein the locking means comprises a locking member insertable with a force fit into the clearance at a location between the pin and the holding means to serve as a wedge.

3. A band attachment assembly according to claim 2; wherein the locking member comprises a plate-like member.

4. A band attachment assembly according to claim 1; wherein the holding means comprises a securing portion secured to the underside of said one end of the wristband, an engaging portion insertable through the clearance for engaging with said rear portion of the article, and an intermediate portion connected at opposite ends to the securing and engaging portions and being disposed in the clearance when the wristband is in said predetermined position.

5. A band attachment assembly according to claim 4; wherein the securing portion has a generally flat shape and overlies the one end of the wristband to which the securing portion is secured.

6. A band attachment assembly according to claim 4; wherein the securing portion has a first part secured to the underside of one end of the wristband, and a second part connected to the first part and inclined in a direction away from the wristband to thereby enable the wristband to bend towards the wrist of the wearer to a greater extent than would otherwise be possible if the first and second parts were coplanar.

7. A band attachment assembly according to claim 4; wherein the holding means comprises a one-piece unitary plate member.

8. A band attachment assembly according to claim 1; wherein the locking means comprises a resiliently deformable locking member coacting with the holding means when in a resiliently deformed state to releasably lock the wristband in said predetermined position.

9. A band attachment assembly according to claim 8; wherein the holding means has means therein defining an opening, and retaining means spaced from the opening for turnably retaining the locking member; and wherein the resiliently deformable locking member has a first projection turnably retained by the retaining means, and a second projection disposed so as to releasably engage in said opening when the locking member is resiliently deformed to thereby releasably lock the wristband in said predetermined position.

10. A band attachment assembly according to claim 9; wherein the holding means has a first part secured to the underside of one end of the wristband, and a second part connected to the first part and inclined in a direction away from the wristband to thereby enable the wristband to bend towards the waist of the wearer to a greater extent than would otherwise be possible if the first and second parts were coplanar.

11. In combination: a watchcase having front and rear portions, and a peripheral side surface extending around the periphery of the watchcase between the front and rear portions; a watchband; and a band attachment assembly for attaching one end of the watchband to the watchcase, the assembly comprising a pin, means connecting the pin to the watchcase to define a clearance between the pin and a side surface portion of the watchcase, holding means secured to said one end of the watchband and inserted through the clearance to a predetermined position for engaging with the rear portion of the watchcase to thereby hold the end face of the one end of the watchband in abutment with the side surface of the watchcase, and locking means for locking the holding means in its predetermined position.

12. A combination according to claim 11; wherein the locking means comprises a locking member inserted with a force fit into the clearance at a location between the pin and the holding means to serve as a wedge.

13. A combination according to claim 12; wherein the locking member comprises a plate-like member.

14. A combination according to claim 11; wherein the holding means comprises a securing portion secured to the underside of said one end of the watchband, an engaging portion engageable with the rear portion of the watchcase, and an intermediate portion connected at opposite ends to the securing and engaging portions and being disposed in the clearance.

15. A combination according to claim 14; wherein the intermediate portion extends in a direction generally parallel to said side surface portion of the watchcase.

16. A combination according to claim 14; wherein the securing portion has a generally flat shape and overlies the one end of the watchband to which the securing portion is secured.

17. A combination according to claim 14; wherein the securing portion has a first part secured to the underside of one end of the watchband; and a second part connected to the first part and inclined in a direction away from the watchband to thereby enable the watchband to bend towards the wrist of a wearer of the watchcase to a greater extent than would otherwise be possible if the first and second parts were coplanar.

18. A combination according to claim 14; wherein the holding means comprises a one-piece unitary plate member.

19. A combination according to claim 11; wherein the locking means comprises a resiliently deformable locking member coacting with the holding means when in a resiliently deformed state to releasably lock the holding means in its predetermined position.

20. A combination according to claim 19; wherein the holding means has means therein defining an opening, and retaining means spaced from the opening for turnably retaining the locking member; and wherein the resiliently deformable locking member has a first projection turnably retained by the retaining means, and a second projection disposed so as to releasably engage in said opening when the locking member is resiliently deformed to thereby releasably lock the holding means in said predetermined position.

21. A combination according to claim 20; wherein the securing portion has a first part secured to the underside of one end of the watchband, and a second part connected to the first part and inclined in a direction away from the watchband to thereby enable the watchband to bend towards the wrist of a wearer of the watchcase to a greater extent than would otherwise be possible if the first and second parts were coplanar.

22. A combination according to claim 11; further including a second watchband and band attachment assembly like those recited in claim 11 for attaching the second watchband to the watchcase at a position diametrically opposite that of the first-mentioned watchband.

* * * * *